US007012461B1

(12) United States Patent
Chen et al.

(10) Patent No.: US 7,012,461 B1
(45) Date of Patent: Mar. 14, 2006

(54) STABILIZATION COMPONENT FOR A SUBSTRATE POTENTIAL REGULATION CIRCUIT

(75) Inventors: Tien-Min Chen, San Jose, CA (US); Robert Fu, Cupertino, CA (US)

(73) Assignee: Transmeta Corporation, Santa Clara, CA (US)

( * ) Notice: Subject to any disclaimer, the term of this patent is extended or adjusted under 35 U.S.C. 154(b) by 0 days.

(21) Appl. No.: 10/747,022

(22) Filed: Dec. 23, 2003

(51) Int. Cl.
*G05F 3/02* (2006.01)

(52) U.S. Cl. ..... 327/535; 327/534

(58) Field of Classification Search ..... 327/534, 327/535, 536, 537; 363/59
See application file for complete search history.

(56) References Cited

U.S. PATENT DOCUMENTS 4,769,784 A * 9/1988 Doluca et al. ..... 327/537
5,920,226 A * 7/1999 Mimura ..... 327/537
6,373,325 B1 * 4/2002 Kuriyama ..... 327/536
6,486,729 B1 * 11/2002 Imamiya ..... 327/536
6,518,828 B1 * 2/2003 Seo et al. ..... 327/534
6,531,912 B1 * 3/2003 Katou ..... 327/536
2002/0130701 A1 * 9/2002 Kleveland ..... 327/536

OTHER PUBLICATIONS

CMOS Circuit Design, Layout and Simulation; R. Jacob Baker, Harry W. Li, David E. Boyce; IEEE Press; 1998.

* cited by examiner

*Primary Examiner*—Terry D. Cunningham

(57) ABSTRACT

A stabilization component for substrate potential regulation for an integrated circuit device. A comparator is coupled to a charge pump to control the charge pump to drive a substrate potential. A stabilization component is coupled to the comparator and is operable to correct an over-charge of the substrate by shunting current from the substrate.

15 Claims, 6 Drawing Sheets

STABILIZATION COMPONENT FOR A SUBSTRATE POTENTIAL REGULATION CIRCUIT

This case is related to commonly assigned U.S. patent application "A PRECISE CONTROL COMPONENT FOR A SUBSTRATE POTENTIAL REGULATION CIRCUIT", by T. Chen, Ser. No. 10/746,539, filed on Dec. 23, 2003, which is incorporated herein in its entirety.

This case is related to commonly assigned U.S. patent application "FEEDBACK-CONTROLLED BODY-BIAS VOLTAGE SOURCE", by T. Chen, U.S. patent application Ser. No. 10/747,016, filed on Dec. 23, 2003, which is incorporated herein in its entirety.

This case is related to commonly assigned U.S. patent application "SERVO-LOOP FOR WELL-BIAS VOLTAGE SOURCE", by Chen, et al., U.S. patent application Ser. No. 10/747,015, filed on Dec. 23, 2003, which is incorporated herein in its entirety.

TECHNICAL FIELD

Embodiments of the present invention relate to body biasing circuits for providing operational voltages in integrated circuit devices.

BACKGROUND ART

As the operating voltages for CMOS transistor circuits have decreased, variations in the threshold voltages for the transistors have become more significant. Although low operating voltages offer the potential for reduced power consumption and higher operating speeds, threshold voltage variations due to process and environmental variables often prevent optimum efficiency and performance from being achieved. Body-biasing is a prior art mechanism for compensating for threshold voltage variations. Body-biasing introduces a reverse bias potential between the bulk and the source of the transistor, allowing the threshold voltage of the transistor to be adjusted electrically. It is important that the circuits that implement and regulate the substrate body biasing function effectively and precisely. Inefficient, or otherwise substandard, body bias control can cause a number of problems with the operation of the integrated circuit, such as, for example, improper bias voltage at the junctions, excessive current flow, and the like.

DISCLOSURE OF THE INVENTION

Embodiments of the present invention provide a stabilization component for substrate potential regulation for an integrated circuit device.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE EMBODIMENTS

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Figure 1:
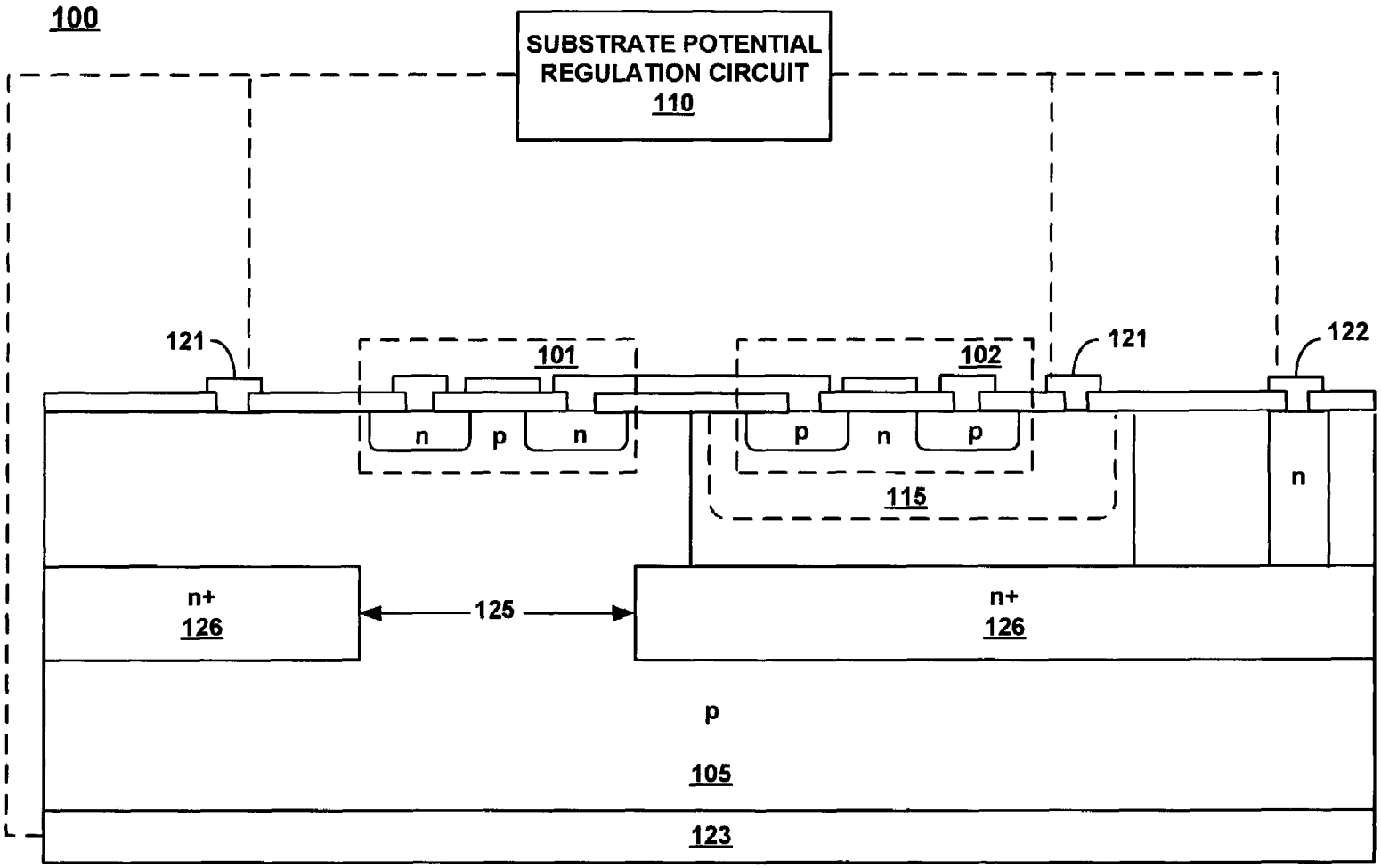
FIG. 1 shows an exemplary integrated circuit device in accordance with one embodiment of the present invention.

FIG. 1 shows an exemplary integrated circuit device 100 in accordance with one embodiment of the present invention. As depicted in FIG. 1, the integrated circuit device 100 shows an inverter having connections to a body-biasing substrate potential regulation circuit 110 (e.g., hereafter regulation circuit 110). The regulation circuit 110 is coupled to provide body bias currents to a PFET 102 through a direct bias contact 121, or by a buried n-well 126 using contact 122. In the FIG. 1 diagram, a p-type substrate 105 supports an NFET 101 and the PFET 102 resides within an n-well 115. Similarly, body-bias may be provided to the NFET 101 by a surface contact 121, or by a backside contact 123. An aperture 125 may be provided in the buried n-well 126 so that the bias potential reaches the NFET 110. In general, the PFET 120 or the NFET 110 may be biased by the regulation circuit 110 through one of the alternative contacts shown. The integrated circuit device 100 employs body-biasing via the regulation circuit 110 to compensate for any threshold voltage variations.

Additional description of the operation of a regulation circuit in accordance with embodiments of the present invention can be found in commonly assigned "FEEDBACK-CONTROLLED BODY-BIAS VOLTAGE SOURCE", by T. Chen, U.S. patent application Ser. No. 10/747,016, filed on Dec. 23, 2003, which is incorporated herein in its entirety.

Figure 2:
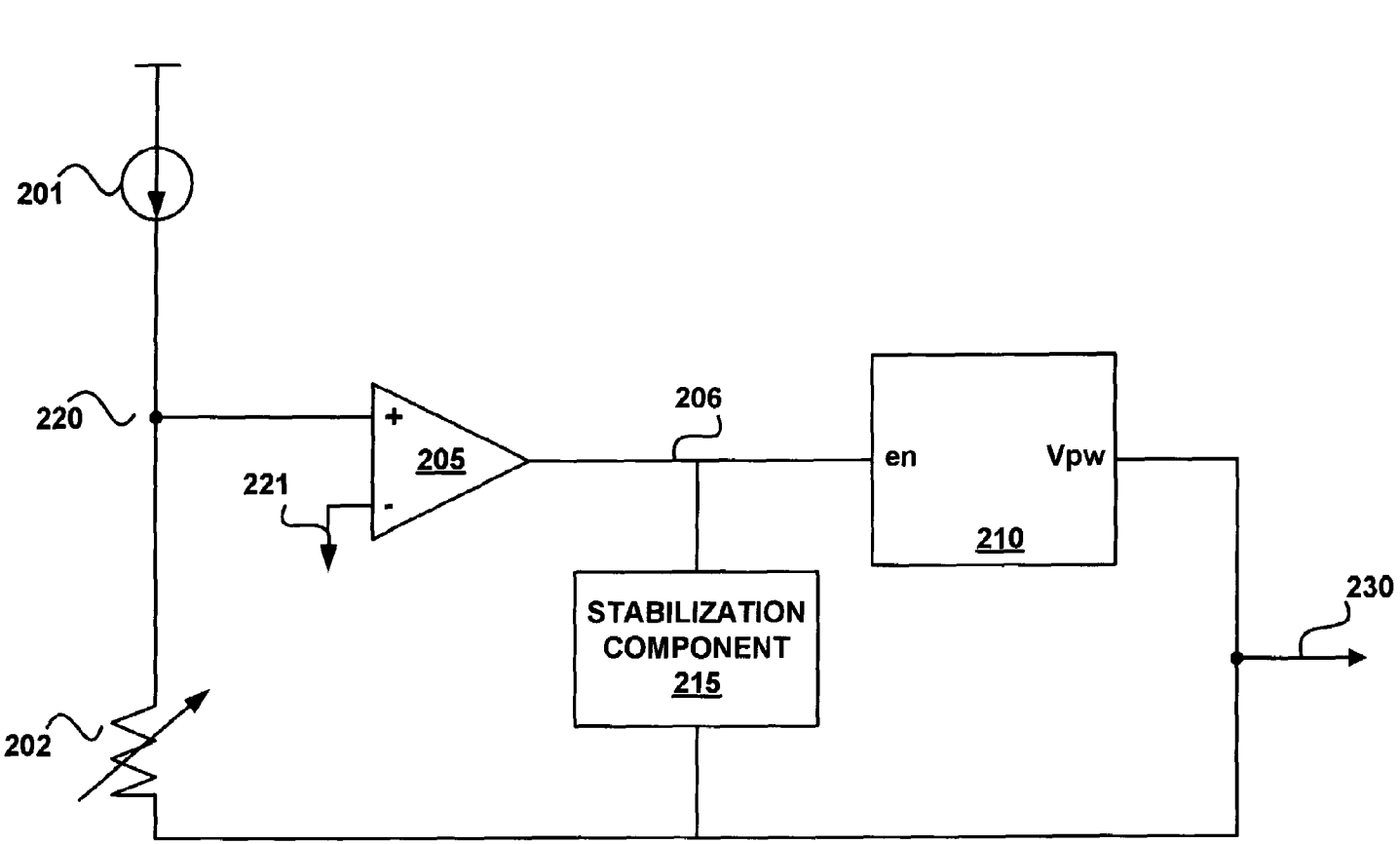
FIG. 2 shows a diagram depicting the internal components of the regulation circuit in accordance with one embodiment of the present invention.

FIG. 2 shows a diagram depicting the internal components of the regulation circuit 200 in accordance with one embodiment of the present invention. The regulation circuit 200 shows one exemplary component configuration suited for the implementation of the regulation circuit 110 shown in FIG. 1 above.

In the regulation circuit 200 embodiment, a current source 201 and a variable resistor 202 are coupled to generate a reference voltage at a node 220 (e.g., hereafter reference voltage 220) as shown. The reference voltage 220 is coupled as an input for a comparator 205. The output of the comparator 205 is coupled to a charge pump 210 and a stabilization component 215. The output of the regulation circuit 200 is generated at an output node 230. The output node 230 can be coupled to one or more body bias contacts of an integrated circuit device (e.g., the contacts 121–123 shown in FIG. 1).

In the regulation circuit 200 embodiment, the current source 201 and the variable resistor 202 form a control circuit, or control component, that determines the operating point of the regulation circuit 200. The current source 201 and the variable resistor 202 determine the reference voltage 220. The comparator 205 examines the reference voltage 220 and the ground voltage 221 and switches on if the reference voltage 220 is higher than the ground voltage 221. The comparator output 206 turns on the charge pump 210, which actively drives the output node 230 to a lower (e.g., negative) voltage. The effect of turning on the charge pump 210 is to actively drive the body bias of a coupled integrated circuit to a lower voltage. This lower voltage will eventually be seen at the reference voltage node 220 of the comparator 205. Once the reference voltage 220 and the ground voltage 221 are equalized, the comparator will switch off, thereby turning off the charge pump 210. With the constant reference current from the current source 201, the body bias of the integrated circuit device will thus be equal to the voltage drop across the variable resistor 202.

Once the charge pump 210 is turned off, the body bias of the integrated circuit device will rise over time as the numerous components of the integrated circuit device sink current to ground. When the reference voltage 220 rises above the ground voltage 221, the comparator 205 will switch on the charge pump 210 to re-establish the desired body bias. A typical value for Vdd for the integrated circuit device is 2.5 volts.

As described above, the current source 201 and the variable resistor 202 determine the reference voltage 220, and thus, the operating point of the regulation circuit 200. The reference voltage 220 is generated by a reference current flowing from the current source 201 through the variable resistor 202. Accordingly, the reference voltage 220 is adjusted by either adjusting the reference current or adjusting the resistance value of the variable resistor 202.

In one embodiment, the reference current is designed for stability and is controlled by a band gap voltage source of the integrated circuit device. Thus, as the temperature of the device changes, the reference current should be stable. Additionally, the reference current should be stable across normal process variation. A typical value for the reference current is 10 microamps. In such an embodiment, the reference voltage 220 is adjusted by changing the variable resistance 202.

In the present embodiment, the stabilization component 215 functions as a stabilizing shunt that prevents over charging of the body bias. As described above, once the charge pump 210 is turned off, the body bias of the integrated circuit device will rise over time as the integrated circuit device sinks current to ground. The stabilization component 215 functions in those cases when the charge pump 210 overcharges the body bias.

Figure 3:
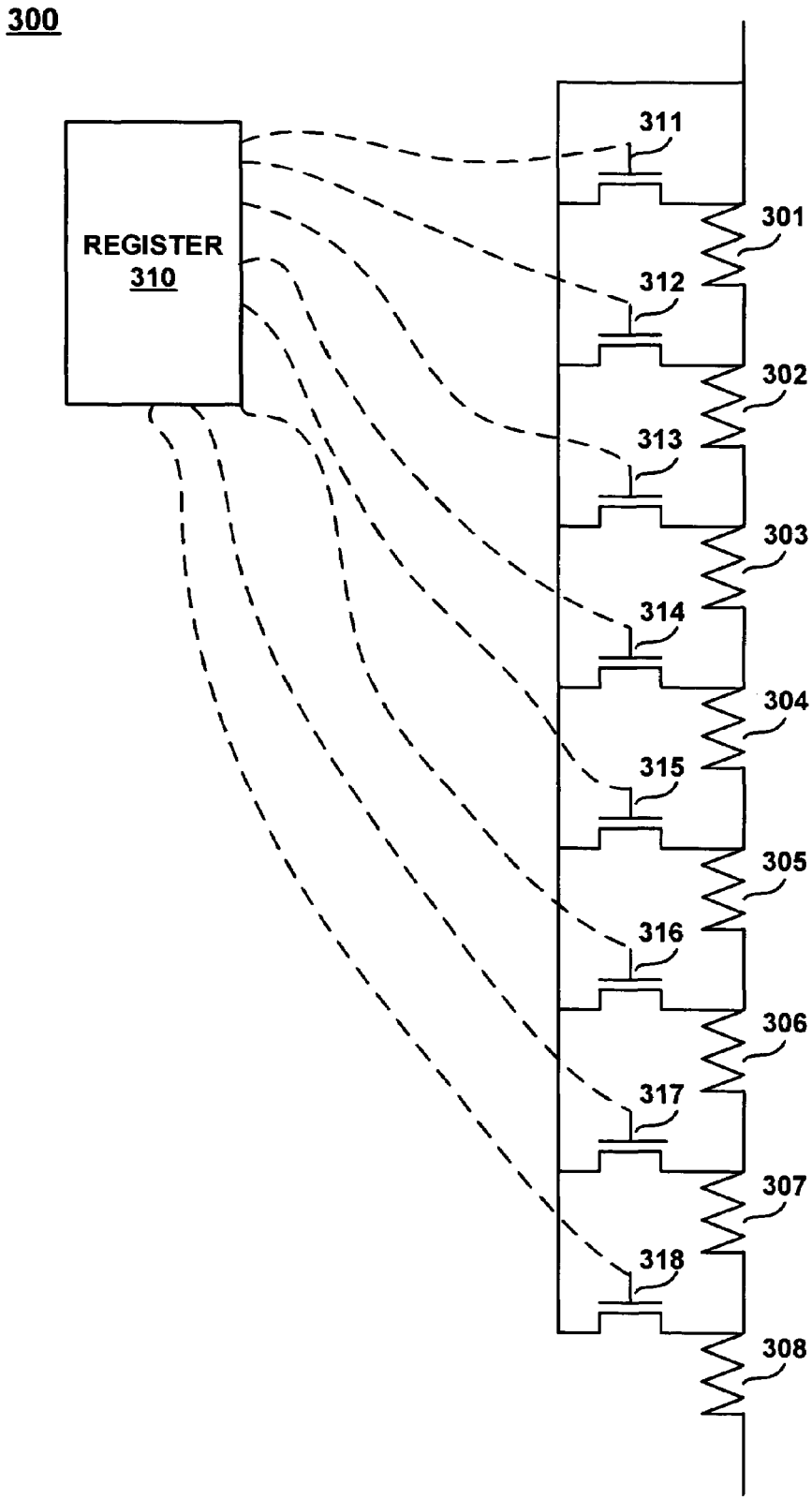
FIG. 3 shows a diagram of a resistor chain in accordance with one embodiment of the present invention.

FIG. 3 shows a diagram of a resistor chain 300 in accordance with one embodiment of the present invention. The resistor chain 300 shows one configuration suited for the implementation of the variable resistor 202 shown in FIG. 2 above. The resistor chain 300 comprises a chain of resistor elements 301–308 arranged in series. In the present embodiment, a resistance value for the resistor chain 300 is selected by tapping a selected one of the resistor elements 301–308. This is accomplished by turning on one of the coupled transistors 311–318. For example, increasing the resistance value is accomplished by tapping a resister earlier in the chain (e.g., resistor 301) 300 as opposed to later in the chain (e.g., resistor 307). The resistance value is selected by writing to a configuration register 310 coupled to control the transistors 311–318.

Figure 4:
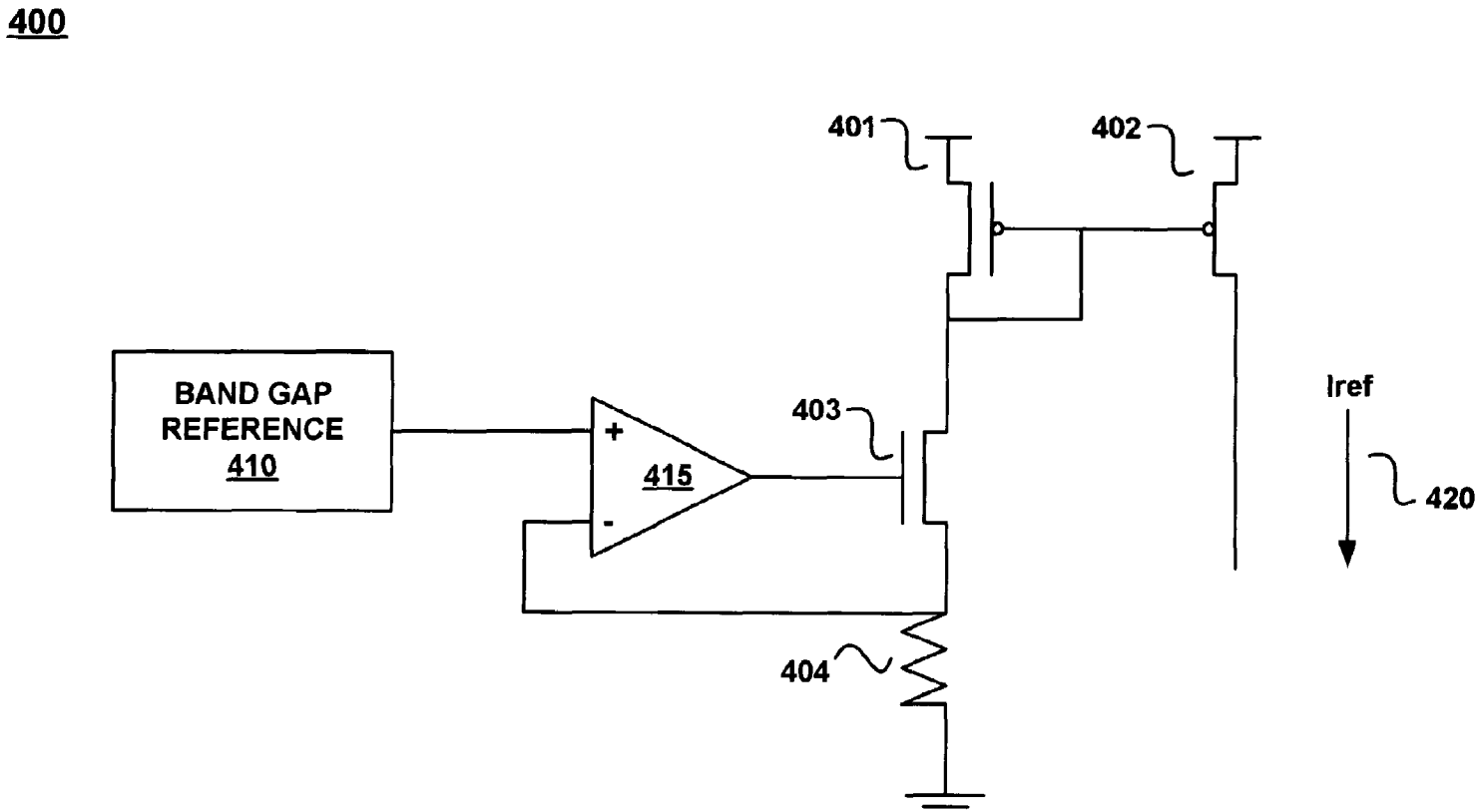
FIG. 4 shows a diagram of a current source in accordance with one embodiment of the present invention.

FIG. 4 shows a diagram of a current source 400 in accordance with one embodiment of the present invention. The current source 400 shows one configuration suited for the implementation of the current source 201 shown in FIG. 2. The current source 400 includes a band gap voltage reference 410 coupled to an amplifier 415. The amplifier 415 controls the transistor 403, which in turn controls the current flowing through the transistor 401 and the resistor 404. This current is mirrored by the transistor 402, and is the reference current generated by the current source 400 (e.g., depicted as the reference current 420).

In this embodiment, the use of a band gap voltage reference 410 results in a stable reference current 420 across different operating temperatures and across different process corners. The reference voltage 220 is governed by the expression K*Vbg, where K is the ratio of the variable resistor 202 and the resistance within the band gap reference 410 and Vbg is the band gap voltage.

Figure 5:
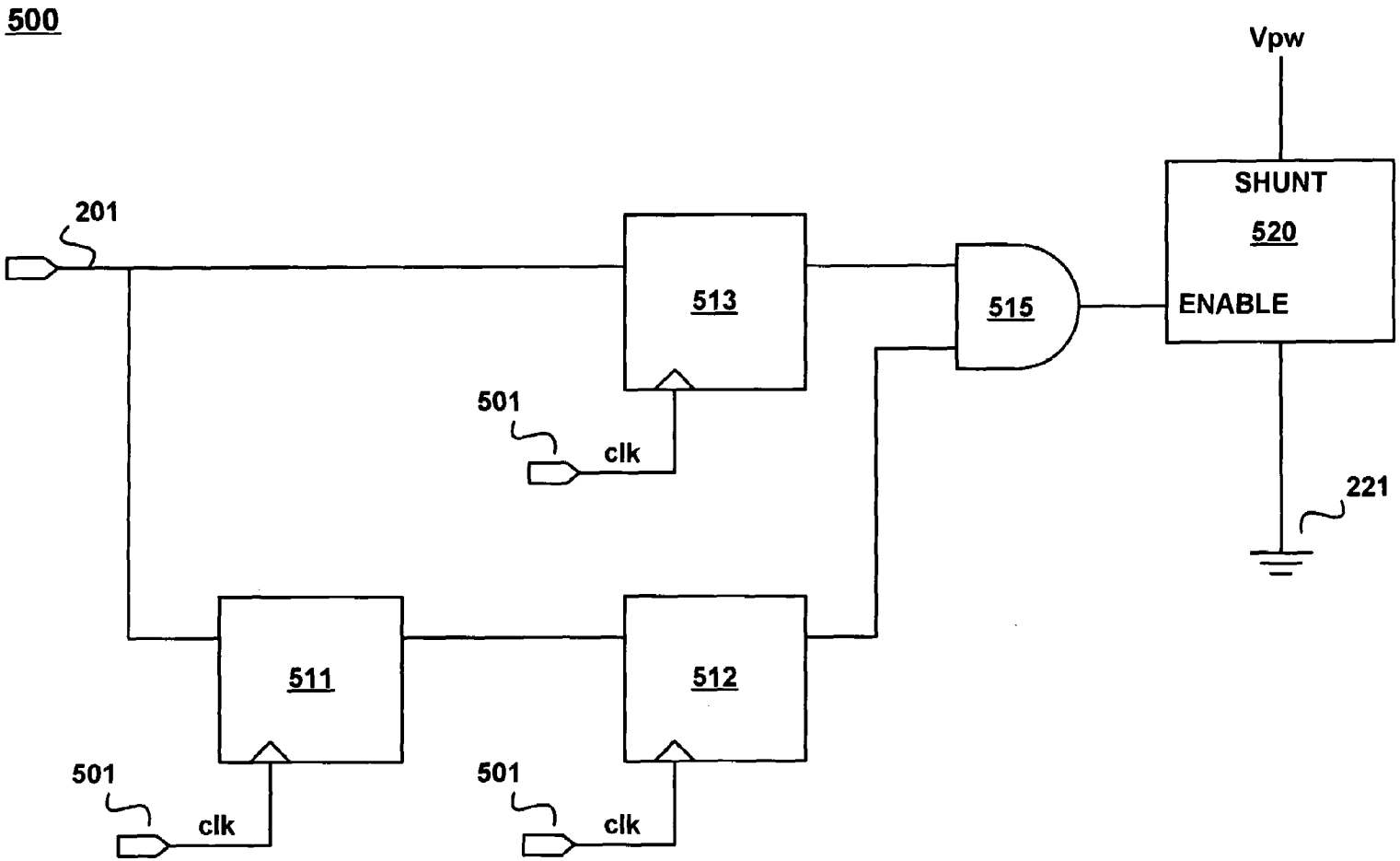
FIG. 5 shows a diagram of a stabilization component in accordance with one embodiment of the present invention.

FIG. 5 shows a diagram of a stabilization component 500 in accordance with one embodiment of the present invention. The stabilization component 500 shows one configuration suited for the implementation of the stabilization component 215 shown in FIG. 2. In the present embodiment, the stabilization component 500 functions as a stabilizing shunt that prevents over charging of the body bias.

As described above, once the charge pump 210 is turned off, the body bias of the integrated circuit device, and thus the ground voltage 221, will rise over time as the integrated circuit device sinks current to ground. The stabilization component 215 functions in those cases when the charge pump 210 overcharges the body bias. For example, there may be circumstances where the charge pump 210 remains on for an excessive amount of time. This can cause an excessive negative charge in the body of the integrated circuit device. The stabilization component 215 can detect an excessive charging action of the charge pump 210.

When excessive charging is detected (e.g., the charge pump 210 being on too long), the stabilization component 215 can shunt current directly between ground and the body bias (e.g., Vpw), thereby more rapidly returning the body bias voltage to its desired level. When the reference voltage 220 rises to the ground voltage 221, the comparator 205 will switch on the charge pump 210 to maintain the desired body bias.

In the stabilization component 500 embodiment, the output of the comparator 205 is coupled as an input to three flip-flops 511–513. The flip-flops 511–513 receive a common clock signal 501. The flip-flops 511 and 512 are coupled in series as shown. The outputs of the flip-flops 512 and 513 are inputs to the AND gate 515. The AND gate 515 controls the enable input of a shunt switch 520.

In normal operation, the comparator output 206 will cycle between logic one and logic zero as the comparator 205 turns off and turns off the charge pump 210 to maintain the voltage reference 220 in equilibrium with ground 221. Thus, the output 206 will oscillate at some mean frequency (e.g., typically 40 MHz). The clock signal 501 is typically chosen to match this frequency. If the comparator output 206 remains high for two consecutive clock cycles, the shunt switch 520 will be enabled, and current will be shunted between, in a negative charge pump case, between Vpw and ground, as depicted. In a positive charge pump case (e.g., FIG. 6) current will be shunted between Vnw and Vdd.

Figure 6:
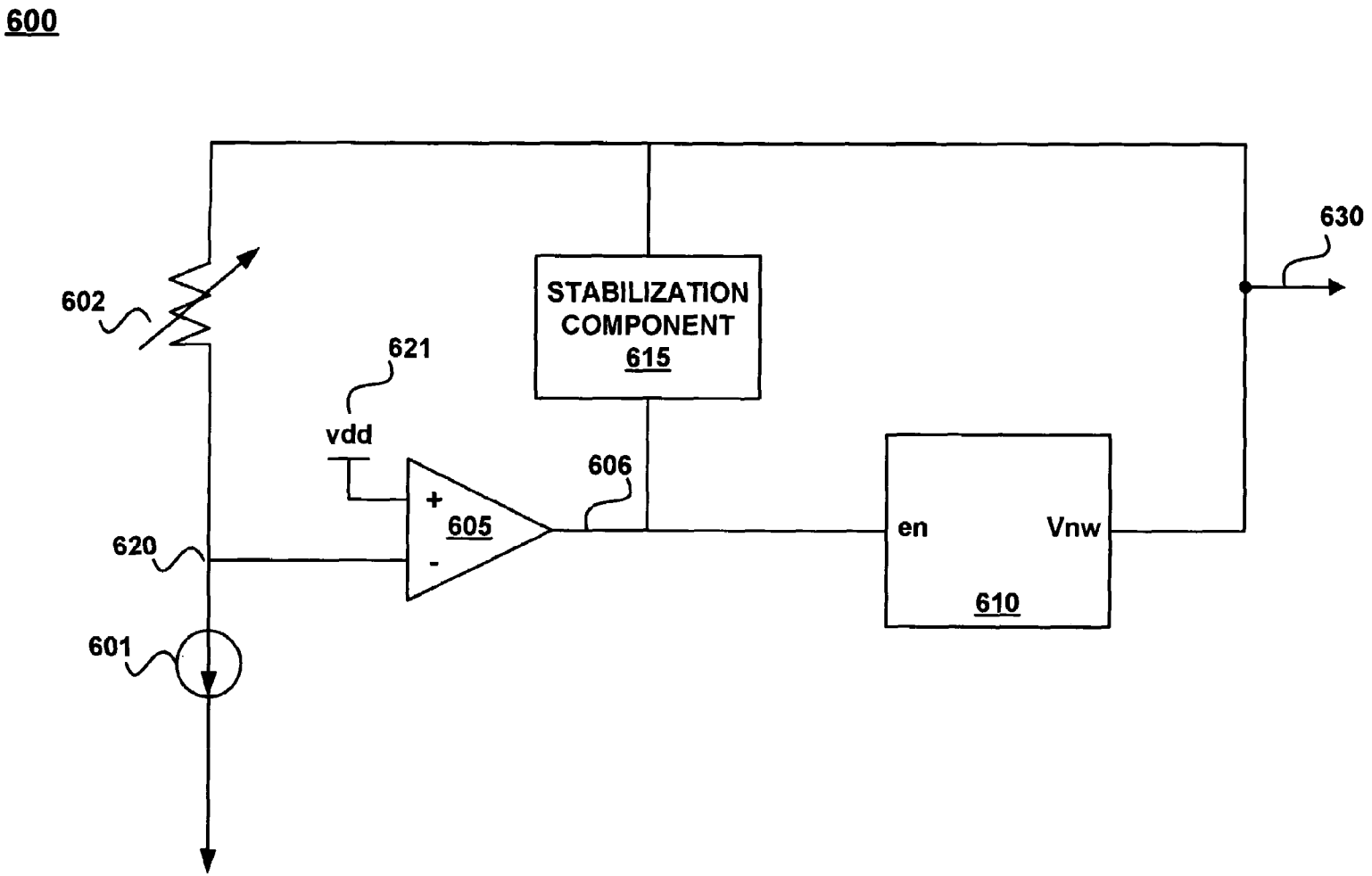
FIG. 6 shows a diagram of a positive charge pump regulation circuit in accordance with one embodiment of the present invention.

FIG. 6 shows a diagram of a positive charge pump regulation circuit 600 in accordance with one embodiment of the present invention. The regulation circuit 600 shows one exemplary component configuration suited for the implementation of a positive charge pump (e.g., Vnw) version of the regulation circuit 110 above.

The regulation circuit 600 embodiment functions in substantially the same manner as the circuit 200 embodiment. A current source 601 and a variable resistor 602 are coupled to generate a reference voltage at a node 620 as shown. The reference voltage 620 is coupled as an input for a comparator 605. The output of the comparator 605 is controls a charge pump 610 and a stabilization component 615. The output of the regulation circuit 600 is generated at an output node 630 and is for coupling to the Vnw body bias contacts of an integrated circuit device.

As with the circuit 200 embodiment, the current source 601 and the variable resistor 602 form a control circuit that determines the operating point. The comparator 605 and the charge pump 610 actively drive the output node 630 to force the reference voltage 620 and Vdd 621 into equilibrium. With the constant reference current from the current source 601, the Vnw body bias of the integrated circuit device will thus be equal to the voltage drop across the variable resistor 602.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A stabilization system for substrate potential regulation for an integrated circuit device, comprising:

a comparator;

a charge pump coupled to the comparator, wherein the comparator controls the charge pump to drive a substrate potential; and a stabilization component coupled to the comparator and operable to correct an over-charge of the substrate by shunting current from the substrate and including a plurality of storage elements operating using a common clock and coupled to detect the charge pump active for more than a predetermined number of clock cycles.

2. The stabilization system of claim 1 further comprising:

a control component configured to generate a reference voltage, wherein the reference voltage is used by the comparator to control the charge pump.

3. The stabilization system of claim 1 wherein the charge pump is a negative charge pump, and wherein the stabilization component is configured to correct an overcharge by shunting current between a P-type well and ground.

4. The stabilization system of claim 1 wherein the charge pump is a positive charge pump, and wherein the stabilization component is configured to correct an overcharge by shunting current between an N-type well and a power supply.

5. The stabilization system of claim 1, further comprising a shunt switch coupled to the storage elements and operable to shunt the current from the substrate when the charge pump is active for more than the predetermined number of clock cycles.

6. The stabilization system of claim 1, wherein the storage elements are coupled to detect the charge pump active for more than two clock cycles.

7. A stabilization circuit for substrate potential regulation for an integrated circuit device, comprising:

a control component configured to generate a reference voltage;

a comparator coupled to the reference voltage, wherein the reference voltage is used by the comparator to control the charge pump;

a charge pump coupled to the comparator, wherein the comparator controls the charge pump to drive a substrate potential; and a stabilization component coupled to the comparator and operable to correct an over-charge of the substrate by shunting current from the substrate and including a plurality of storage elements operating using a common clock and coupled to detect the charge pump active for more than a predetermined number of clock cycles.

8. The stabilization circuit of claim 7 wherein the charge pump is a negative charge pump, and wherein the stabilization component is configured to correct an overcharge by shunting current between a P-type well and ground.

9. The stabilization circuit of claim 7 wherein the charge pump is a positive charge pump, and wherein the stabilization component is configured to correct an overcharge by shunting current between an N-type well and a power supply.

10. The stabilization circuit of claim 7, further comprising a shunt switch coupled to the storage elements and operable to shunt the current from the substrate when the charge pump is active for more than the predetermined number of clock cycles.

11. The stabilization circuit of claim 7, wherein the storage elements are coupled to detect the charge pump active for more than two clock cycles.

12. A method for integrated circuit device substrate potential regulation, comprising:

controlling a charge pump to drive a substrate potential of the integrated circuit device, the charge pump controlled by a coupled comparator;

detecting the charge pump active for more than a predetermined number of clock cycles by using a stabilization component coupled to the comparator and including a plurality of storage elements coupled to a common clock; and correcting an over-charge of the substrate by using the stabilization component to shunt current from the substrate.

13. The method of claim 12, further comprising:

generating a reference voltage by using a control component, wherein the reference voltage is used by the comparator to control the charge pump.

14. The method of claim 12, wherein the charge pump is a negative charge pump, and wherein the stabilization component is configured to correct an overcharge by shunting current between a P-type well and ground.

15. The method of claim 12, wherein the charge pump is a positive charge pump, and wherein the stabilization component is configured to correct an overcharge by shunting current between an N-type well and a power supply.

* * * * *